US010053315B2

(12) United States Patent
Ikegami

(10) Patent No.: US 10,053,315 B2
(45) Date of Patent: Aug. 21, 2018

(54) SHEET CONVEYER AND IMAGE FORMING APPARATUS

(71) Applicant: Brother Kogyo Kabushiki Kaisha, Nagoya-shi, Aichi-ken (JP)

(72) Inventor: Yusuke Ikegami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/816,212

(22) Filed: Nov. 17, 2017

(65) Prior Publication Data

US 2018/0141767 A1 May 24, 2018

(30) Foreign Application Priority Data

Nov. 24, 2016 (JP) ..... 2016-228169

(51) Int. Cl.

| | |
|---|---|
| ***B65H 3/06*** | (2006.01) |
| ***B65H 1/04*** | (2006.01) |
| ***B65H 29/20*** | (2006.01) |
| ***G03G 15/00*** | (2006.01) |

(52) U.S. Cl.

CPC ..... *B65H 3/0684* (2013.01); *B65H 1/04* (2013.01); *B65H 3/0661* (2013.01); *B65H 29/20* (2013.01); *G03G 15/6529* (2013.01); *B65H 2801/03* (2013.01)

(58) Field of Classification Search

CPC ..... B65H 3/0684; B65H 2403/51; B65H 2403/512; B65H 2403/514; B65H 2404/1521; B65H 2402/31; B65H 2402/341

See application file for complete search history.

(56) References Cited

U.S. PATENT DOCUMENTS

| | | | | |
|---|---|---|---|---|
| 4,900,003 | A * | 2/1990 | Hashimoto | B65H 3/0669 271/114 |
| 5,893,555 | A * | 4/1999 | Kawada | B65H 1/14 271/117 |
| 7,648,134 | B2 * | 1/2010 | Lim | B65H 3/0607 271/117 |
| 9,221,634 | B2 * | 12/2015 | Tanaka | B65H 3/0669 |
| 9,873,576 | B2 * | 1/2018 | Kondo | B65H 3/0684 |
| 9,988,225 | B1 * | 6/2018 | Ikegami | B65H 3/0684 |

(Continued)

FOREIGN PATENT DOCUMENTS

| | | |
|---|---|---|
| JP | H07-097078 | 4/1995 |
| JP | H11-171354 A | 6/1999 |

*Primary Examiner* — Luis A Gonzalez

(74) *Attorney, Agent, or Firm* — Banner & Witcoff, Ltd.

(57) ABSTRACT

A sheet conveyer having a tray, a feed roller, a separator roller, a holder, an arm, a load applier unit, and a cam member is provided. The load applier unit includes a contacting member, a lever, and a contractive spring. One of the contacting member and the arm has one of a protrusion and a hole section, and the other of the contacting member and the arm has the other of the protrusion and the hole section. The holder is maintained in a second holder-position when the protrusion contacts one end of the hole section and applies a weight of the load applier unit to the arm and maintained in the first holder-position when the protrusion contacts the other end of the hole section and applies a load from the contractive spring acting in a direction to press the feed roller against sheets to the arm.

5 Claims, 10 Drawing Sheets

(56) References Cited

U.S. PATENT DOCUMENTS

| | | | | |
|---|---|---|---|---|
| 2016/0347560 | A1* | 12/2016 | Murata | B65H 3/0669 |
| 2018/0057289 | A1* | 3/2018 | Okamoto | B65H 3/0684 |
| 2018/0088510 | A1* | 3/2018 | Fujioka | G03G 15/6511 |

* cited by examiner

SHEET CONVEYER AND IMAGE FORMING APPARATUS

CROSS REFERENCE TO RELATED APPLICATION

This application claims priority from Japanese Patent Application No. 2016-228169, filed on Nov. 24, 2016, the entire subject matter of which is incorporated herein by reference.

BACKGROUND

Technical Field

An aspect of the present disclosure is related to a sheet conveyer having a feed roller and to an image forming apparatus having the sheet conveyer.

Related Art

A sheet conveyer, having a feed roller to feed sheets supported on a tray and a separator roller to separate the fed sheets from one another, is known. The feed roller may be urged against the sheets while a holder to hold the feed roller and the separator roller is pulled in one direction by a spring hooked to the holder so that a specific intensity of pressure to convey the sheets may be applied to the sheets through the feed roller.

SUMMARY

In such a sheet conveyer, the feed roller may be pressed against the sheets through the holder being pulled by the spring. Therefore, while the substantial amount of pressure is applied to the feed roller by an urging force of the spring, when the feed roller with the pressure applied thereto is placed on the sheets, the feed roller may produce a large colliding noise.

The present disclosure is advantageous in that a noise-reducible sheet conveyer, wherein a feed roller may be pressed against sheets to feed the sheets, and in which a colliding noise when the feed roller contacts the sheet may be reduced, and an image forming apparatus having the sheet conveyer, are provided.

According to an aspect of the present disclosure, a sheet conveyer, having a tray, a feed roller, a separator roller, a holder, an arm, a load applier unit, and a cam member, is provided. The tray is configured to support a plurality of sheets. The feed roller is configured to contact one of the plurality of sheets and rotate to convey the one of the plurality of sheets in a conveying direction. The separator roller is arranged downstream from the feed roller along the conveying direction. The separator roller is configured to separate the one of the plurality of sheets conveyed by the feed roller from the other of the plurality of sheets. The holder is supported swingably to swing about a rotation shaft of the separator roller. The holder supports the feed roller rotatably. The arm extends along an axial direction of the rotation shaft of the separator roller. The arm is engaged with the holder and configured to swing the holder. The load applier unit is configured to apply a load to the holder through the arm. The load applier unit includes a contacting member engaged with the arm; a lever movable in a vertical direction; and a contractive spring engaged with the contacting member and the lever to contract in a contracting direction to pull the contacting member and the lever to be closer to each other. The cam member is configured to be driven by a driving source to move the lever in the vertical direction. One of the contacting member and the arm has one of a protrusion vertically movable and a hole section engageable with the protrusion, and the other of the contacting member and the arm has the other of the protrusion and the hole section. A dimension of the hole section in the vertical direction is greater than a dimension of the protrusion in the vertical direction. The protrusion is movable in the hole section while the feed roller stays contacting the one of the plurality of sheets to shift between a state, in which the protrusion contacts one end of the hole section, and a state, in which the protrusion contacts the other end of the hole section. The holder is movable between a first holder-position, in which the feed roller contacts the one of the plurality of sheets, and a second holder-position, in which the feed roller is separated from the one of the plurality of sheets. The holder is maintained in the second holder-position against a weight of the feed roller when the protrusion contacts the one end of the hole section and applies a weight of the load applier unit to the arm. The holder is maintained in the first holder-position when the protrusion contacts the other end of the hole section and applies a load by an urging force from the contractive spring that acts in a direction to press the feed roller against the plurality of sheets to the arm.

According to another aspect of the present disclosure, an image forming apparatus having an image forming unit and a sheet conveyer is provided. The sheet conveyer includes a tray, a feed roller, a separator roller, a holder, an arm, a load applier unit, and a cam member. The tray is configured to support a plurality of sheets. The feed roller is configured to contact one of the plurality of sheets and rotate to convey the one of the plurality of sheets in a conveying direction. The separator roller is arranged downstream from the feed roller along the conveying direction. The separator roller is configured to separate the one of the plurality of sheets conveyed by the feed roller from the other of the plurality of sheets. The holder is supported swingably to swing about a rotation shaft of the separator roller. The holder supports the feed roller rotatably. The arm extends along an axial direction of the rotation shaft of the separator roller. The arm is engaged with the holder and configured to swing the holder. The load applier unit is configured to apply a load to the holder through the arm. The load applier unit includes a contacting member engaged with the arm; a lever movable in a vertical direction; and a contractive spring engaged with the contacting member and the lever to contract in a contracting direction to pull the contacting member and the lever to be closer to each other. The cam member is configured to be driven by a driving source to move the lever in the vertical direction. One of the contacting member and the arm has one of a protrusion vertically movable and a hole section engageable with the protrusion, and the other of the contacting member and the arm has the other of the protrusion and the hole section. A dimension of the hole section in the vertical direction is greater than a dimension of the protrusion in the vertical direction. The protrusion is movable in the hole section while the feed roller stays contacting the one of the plurality of sheets to shift between a state, in which the protrusion contacts one end of the hole section, and a state, in which the protrusion contacts the other end of the hole section. The holder is movable between a first holder-position, in which the feed roller contacts the one of the plurality of sheets, and a second holder-position, in which the feed roller is separated from the one of the plurality of sheets. The holder is maintained in the second holder-position against a weight of the feed roller when the protrusion contacts the one end of the hole section and applies a weight of the load applier unit to the arm. The holder is maintained in the first holder-position when the protrusion contacts the other end of the hole section and applies a load by an urging force from the contractive spring that acts in a direction to press the feed roller against the plurality of sheets to the arm.

BRIEF DESCRIPTION OF THE ACCOMPANYING DRAWINGS

DETAILED DESCRIPTION

Hereinafter, an embodiment of the present disclosure will be described with reference to the accompanying drawings.

[Overall Configuration of Image Forming Apparatus]

Figure 1A:
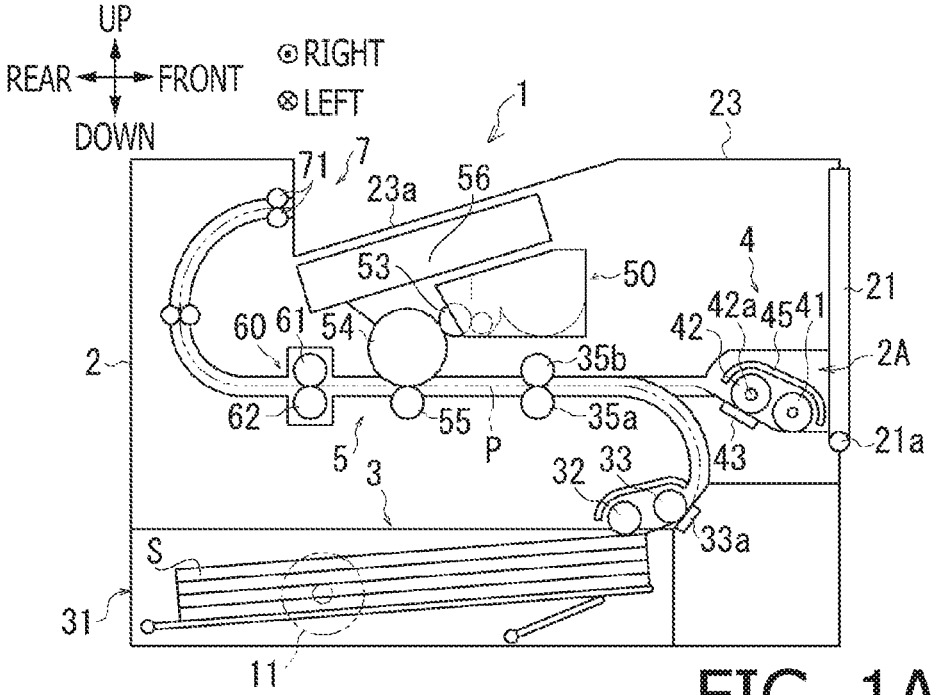
FIG. 1A is an illustrative cross-sectional view of an image forming apparatus having a sheet conveyer, with a multi-purpose (MP) tray being in a closure position, according to an embodiment of the present disclosure.
Figure 1B:
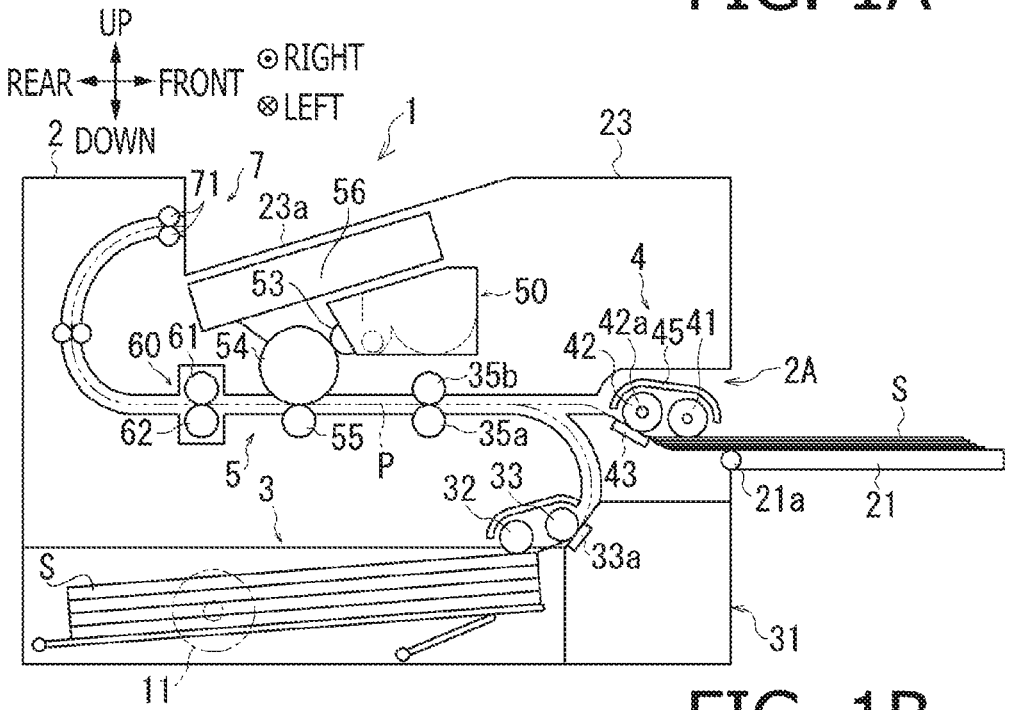
FIG. 1B is an illustrative cross-sectional view of the image forming apparatus, with the MP tray being in an open position, according to the embodiment of the present disclosure.

An image forming apparatus 1 includes, as shown in FIGS. 1A-1B, a housing 2, an image forming unit 5, a sheet feeder 3, a sheet conveyer 4, and a motor 11. The image forming unit 5 may form an image on one or more sheets S. The sheet feeder 3 may feed the sheets S to the image forming unit 5. The sheet conveyer 4 may convey manually inserted sheets S toward the image forming unit 5. The motor 11 is a driving source to generate a driving force to drive movable devices in the image forming apparatus 1.

In the following description, directions related the image forming apparatus 1 and each part or item included in the image forming apparatus 1 will be mentioned on basis of a user's position to ordinarily use the image forming apparatus 1. For example, in FIG. 1A, a viewer's right-hand side and left-hand side will be referred to as the user's frontward side and rearward side, respectively. A viewer's nearer side and farther side in FIG. 1A will be referred to as a rightward side and a leftward side for the user to use the image forming apparatus 1, respectively. An up-to-down or down-to-up direction in FIG. 1A may be referred to as a vertical direction, and a front-to-rear or rear-to-front direction may be referred to as a front-rear direction. Further, a left-to-right or right-to-left direction may be referred to as a widthwise direction.

The housing 2 may be in a form of a rectangular box and accommodates the sheet feeder 3, the image forming unit 5, and a sheet ejector 7. The housing 2 includes an openable section 2A, which is a room open frontward, and a multi-purpose (MP) tray 21, which is swingable to cover or expose the openable section 2A. An upper part of the housing 2 is covered by an upper cover 23.

The MP tray 21 is pivotable about a pivot axis 21*a*, which is at a lower end of the MP tray 21 and extends horizontally along the widthwise direction. The MP tray 21 is pivotable between a closure position, in which the MP tray 21 covers the openable section 2A, and an open position, in which the MP tray 21 exposes the openable section 2A. When the MP tray 21 is in the open position, the sheets S to be manually inserted may be placed on the MP tray 21. An upper face of the upper cover 23 is dented to form an ejection tray 23*a*, which inclines to be lower rearward and higher frontward.

The sheet feeder 3 includes a sheet cassette 31, a feed roller 32, a separator roller 33, a separator pad 33*a*, and paired registration rollers 35*a*, 35*b*. Inside the housing 2, formed is a conveyer path P, which extends from the sheet cassette 31 through the image forming unit 5 to the ejection tray 23*a*.

The sheet cassette 31 may support one or more sheets S therein in a stack. The sheets S supported in the sheet cassette 31 may be fed by the feed roller 32 toward the separator roller 33 and separated from one another by the separator roller 33 and the separator pad 33*a* to be conveyed in the conveyer path P one by one.

The sheets S fed in the conveyer path P may be further conveyed by the paired registration rollers 35*a*, 35*b*, which are located downstream along the conveyer path P from the separator roller 33, toward the image forming unit 5. The paired registration rollers 35*a*, 35*b* may stop a leading edge of the sheet S being conveyed for a short moment and resume conveyance of the sheet S at a predetermine timing to convey the sheet S toward a transferring position in the image forming unit 5.

The image forming unit 5 is arranged at an upper position with respect to the sheet cassette 31 and may form an image on a surface of the sheet S conveyed from the sheet feeder 3. The image forming unit 5 includes a process cartridge 50, an exposure unit 56, and a fuser unit 60. The process cartridge 50 may transfer an image on a surface of the sheet S being conveyed, the exposure unit 56 may expose the surface of the sheet S to light, and the fuser unit 60 may fix the image, which was transferred onto the sheet S in the process cartridge 50, thereon.

The process cartridge 50 includes a developer roller 53, a photosensitive drum 54, and a transfer roller 55.

The exposure unit 56 includes a laser diode, a polygon mirror, lenses, and reflector mirrors, which are not shown.

The laser diode may emit a laser beam at a surface of the photosensitive drum 54 based on image data input to the image forming apparatus 1 so that the surface of the photosensitive drum 54 may be selectively exposed to the laser beam.

The photosensitive drum 54 is arranged in adjacent to the developer roller 53. The surface of the photosensitive drum 54 may be positively charged evenly by a charger, which is not shown, and may be selectively exposed to the laser beam in the exposure unit 56 according to the image data. Potential in the area exposed to the laser beam may be lowered to form an electrostatic latent image on the photosensitive drum 54. Thereafter, positively charged toner may be supplied to the electrostatic latent image on the photosensitive drum 54 by the developer roller 53 so that the electrostatic image may be developed to be a toner image.

The transfer roller 55 is arranged to face the photosensitive drum 54. A bias applier, which is not shown, may apply negative transferring bias to a surface of the transfer roller 55. The sheet may be conveyed through the transferring position between the transfer roller 55, of which surface is negatively biased, and the photosensitive drum 55, on which the developed toner image is carried, so that the toner image carried on the photosensitive drum 54 may be transferred to the surface of the sheet S.

The fuser unit 60 includes a heat roller 61 and a pressure roller 62. The heat roller 61 may rotate by the driving force from the motor 11 and may be heated by electricity supplied from an electric power source, which is not shown. The pressure roller 62 is arranged to face and contact the heat roller 61 and may be driven to rotate by rotation of the heat roller 61. As the sheet S with the transferred toner image thereon enters the fuser unit 60, the sheet S is conveyed through a position between the heat roller 61 and the pressure roller 62 so that the toner image may be fixed at the surface of the sheet S.

The sheet ejector 7 includes paired ejector rollers 71, 71 to eject the sheet S conveyed from the fuser unit 60 outside the housing 2. Specifically, the paired ejector rollers 71, 71 may further convey the sheet S conveyed from the fuser unit 60 to rest in the ejection tray 23*a* formed on the upper side of the upper cover 23.

The sheet conveyer 4 is, as shown in FIG. 1B, disposed in the openable section 2A to convey the sheets S inserted manually through the MP tray 21 toward the image forming unit 5.

[Sheet Conveyer]

Figure 2:
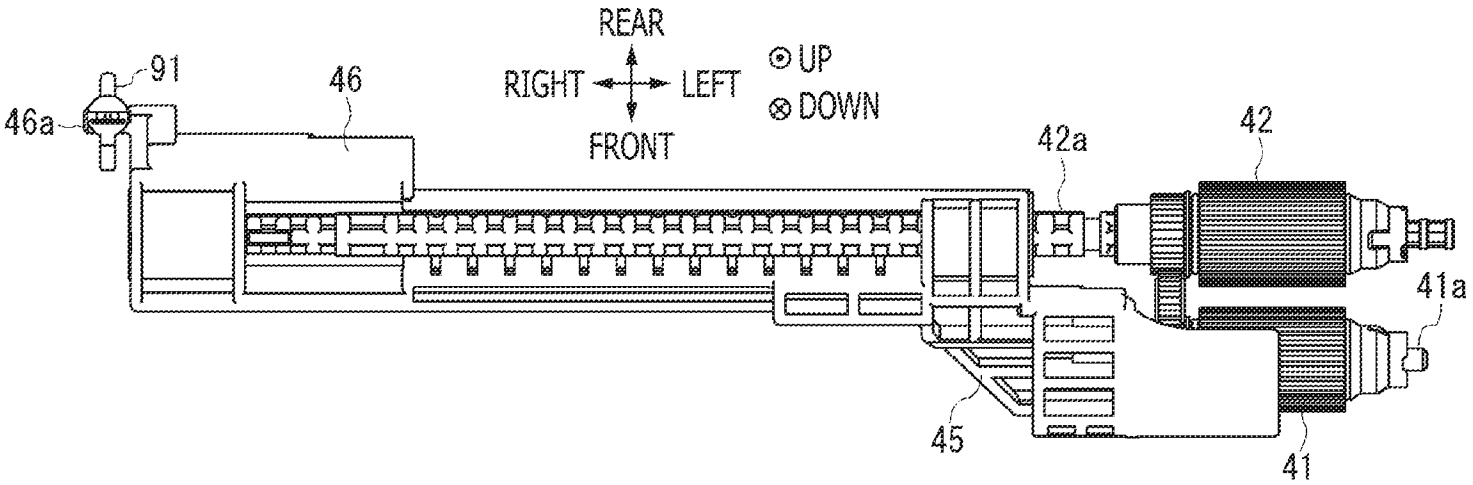
FIG. 2 is a plan view of a separator roller, a feed roller, an arm, and a holder in the sheet conveyer according to the embodiment of the present disclosure.

Below will be described the sheet conveyer 4. The sheet conveyer 4 includes, as shown in FIGS. 1B and 2, the MP tray 21, a feed roller 41, a separator roller 42, a separator pad 43, the motor 11, a holder 45, and an arm 46. The MP tray 21 may support one or more sheets S thereon in a stack. The feed roller 41 may contact the sheets S on the MP tray 21 and rotate to feed the sheets S to the separator roller 42. The separator roller 42 is arranged at a downstream position from the feed roller 41 along a conveying direction for the sheets S to be conveyed. The separator pad 43 is arranged to face the separator roller 42. The motor 11 may supply a driving force to the feed roller 41 and the separator roller 42. The holder 45 supports the feed roller 41. The arm 46 extends along an axial direction of a rotation shaft 42*a* of the separator roller 42.

The separator roller 42 is rotatably supported by the housing 2 to rotate about the rotation shaft 42*a*. The separator roller 42 may separate the sheets S fed by the feed roller 41 from one another in conjunction with the separator pad 43 and convey the separated sheet S downstream in the conveying direction.

Figure 3:
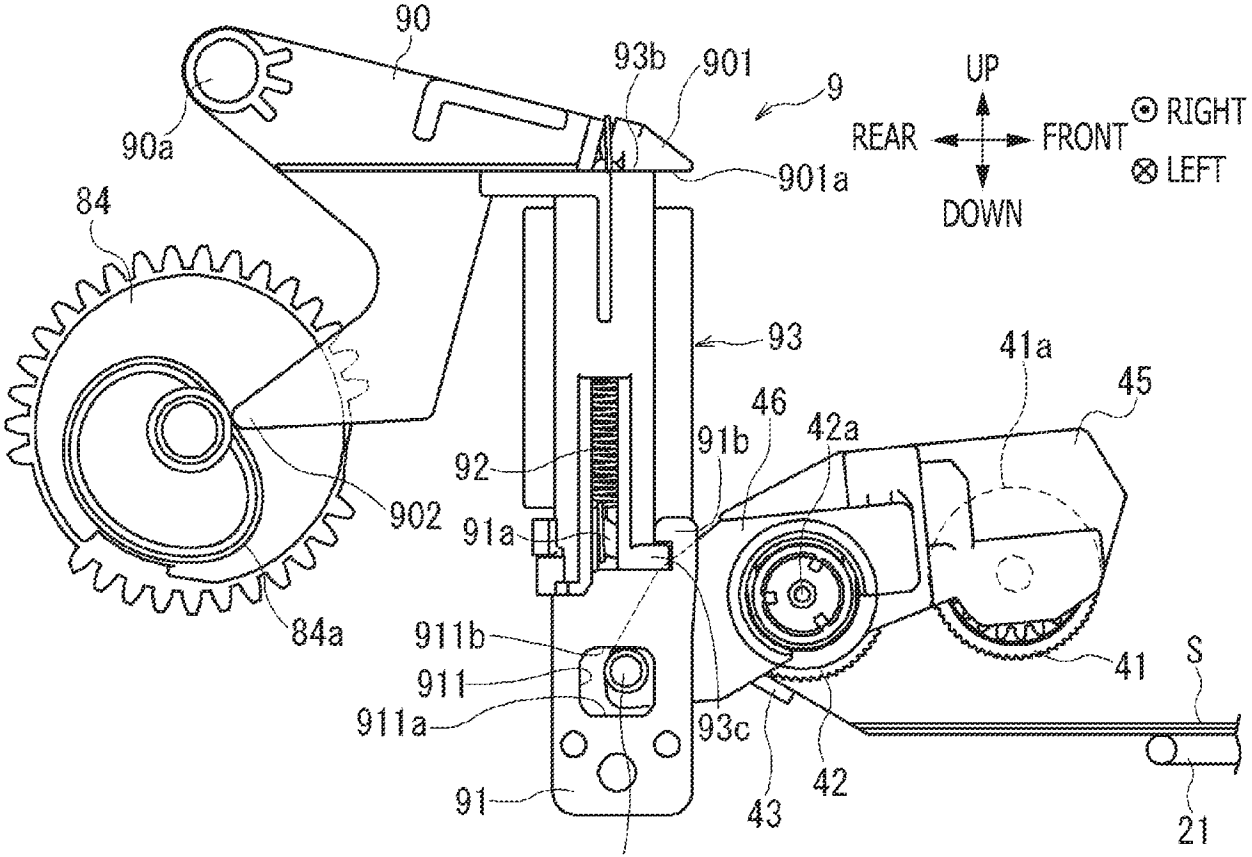
FIG. 3 is a sideward view of the sheet conveyer according to the embodiment of the present disclosure with a lever being in a second position.

The holder 45 is, as shown in FIGS. 2 and 3, swingably supported by the rotation shaft 42*a* of the separator roller 42 to swing about the rotation shaft 42*a*. Further, the holder 45 supports the feed roller 41 rotatably so that the feed roller 41 may rotate about a rotation shaft 41*a* of the feed roller 41. The feed roller 41, the separator roller 42, and the holder 45 are arranged in a widthwise central area in the sheet conveyer 4. The rotation shaft 42*a* of the separator roller 42 extends rightward from the separator roller 42 to reach a rightward end area of the sheet conveyer 4.

The feed roller 41 is located frontward from the rotation shaft 42*a* of the separator roller 42. The holder 45 supports the separator roller 42 rotatably, at an intervening position between a protrusion 46*a* and the feed roller 41 with regard to the front-rear direction, so that the separator roller 42 may rotate about the rotation shaft 42*a*. As the holder 45 swings about the rotation shaft 42*a* of the separator roller 42, the feed roller 41 and the arm 46 swing about the rotation shaft 42*a* integrally along with the holder 45.

The arm 46 is engaged with the holder 45 and extends rightward from the holder 45. At a rightward end of the arm 46, formed is the protrusion 46*a* protruding rightward. The protrusion 46*a* is located rearward from the rotation shaft 42*a* of the separator roller 42 with regard to the front-rear direction. The arm 46 may swing the holder 45 about the rotation shaft 42*a* while the protrusion 46*a* moves vertically.

The feed roller 41 is swingable about the rotation shaft 42*a* to drop downward due to a weight thereof by an effect of gravity, when substantially no external force is applied to the holder 45, and contact the sheets S supported by the MP tray 21. On the other hand, when the protrusion 46*a* is subjected to a load that may lift the protrusion 46*a* upward, the holder 45 is subjected to a force that may act in a direction to swing the feed roller 41 about the rotation shaft 42*a* further downward. Thus, the feed roller 41 may be pressed against the sheets S supported by the MP tray 21. In other words, when a load in an upward direction is applied to the protrusion 46*a*, a load acting in a direction to press the feed roller 41 against the sheet S supported on the MP tray 21 may be applied to the holder 45.

Meanwhile, when a load in a downward direction is applied to the protrusion 46*a* of the arm 46, a load acting in a direction to cause the feed roller 41 to swing upward may be applied to the holder 45. Therefore, the feed roller 41 may swing in a direction to be separated from the sheets S supported on the MP tray 21 against the weight thereof. The holder 45 is movable between a first holder-position, in which the feed roller 41 contacts the sheet S, and a second holder-position, in which the feed roller 41 is separated from the sheet S.

Figure 4:
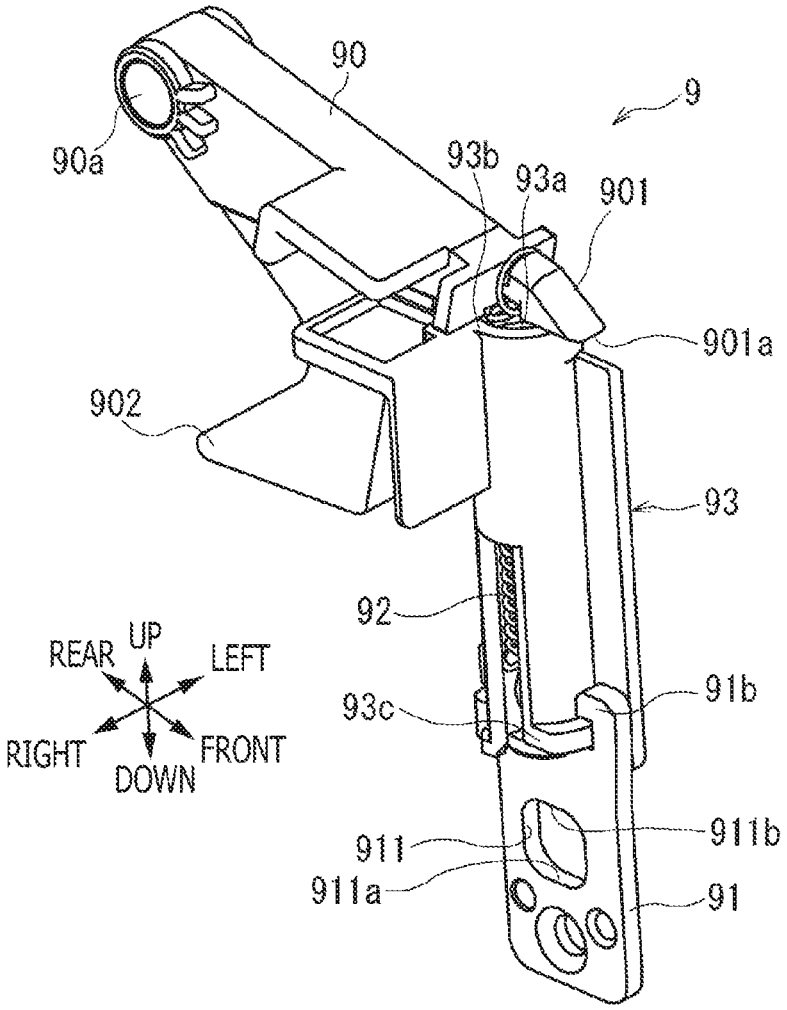
FIG. 4 is a perspective view of a load applier unit in the sheet conveyer according to the embodiment of the present disclosure.
Figure 5:
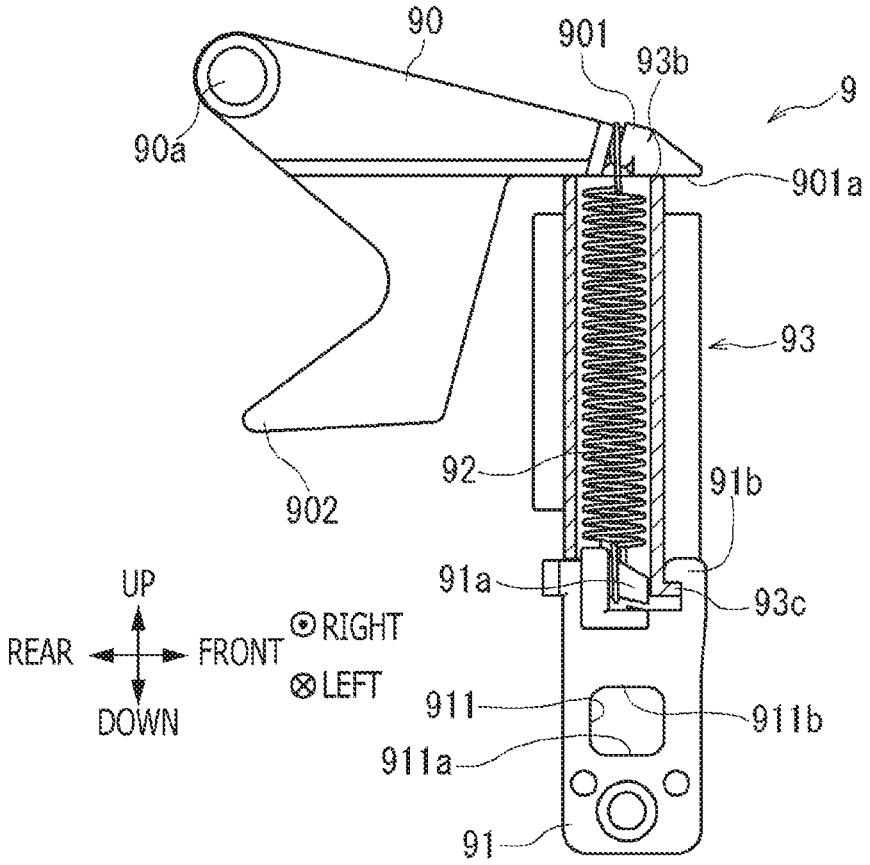
FIG. 5 is a cross-sectional view of the load applier unit in the sheet conveyer according to the embodiment of the present disclosure.

As shown in FIGS. 3-5, the sheet conveyer 4 includes a contacting member 91, a lever 90, a contractive spring 92, a preloading member 93, and a cam member 84. The contacting member 91 is engageable with the protrusion 46*a* of the arm 46. The lever 90 is movable in the vertical direction. The contractive spring 92 is interposed between the contacting member 91 and the lever 90. The preloading member 93 is interposed between the contacting member 91 and the lever 90 to hold the contractive spring 92 in a stretched condition to be longer than a natural length. The cam member 84 may be driven by the motor 11 to rotate.

The contractive spring 92 is engaged with an engageable section 901 of the lever 90 at a first end, e.g., an upper end in FIG. 3, and with an engageable section 91*a* of the contacting member 91 at a second end, e.g., a lower end in FIG. 3. The contractive spring 92 may contract to pull the lever 90 and the contacting member 91 to be closer to each other. A load applier unit 9, which may apply a load through the arm 46 to the holder 45, includes the contacting member 91, the lever 90, the contractive spring 92, and the preloading member 93.

The lever 90 is swingable about a swing axis 90*a*. A swinging movement of the lever 90 may move the engageable section 901 engaged with the contractive spring 92 in the vertical direction. Meanwhile, the cam member 84 includes a cam section 84*a*, and the lever 90 includes a contact section 902, at which the lever 90 contacts the cam section 84*a*.

The lever 90 is movable, when the cam member 84 is driven to rotate, between a first position, in which the engageable section 901 is moved upward by the cam section 84*a* (see FIG. 9), and a second position, in which the engageable section 901 is moved downward by the cam section 84*a* (see FIG. 3).

The preloading member 93 is formed in a tubular shape, in which a through hole 93*a* to accommodate the contractive spring 92 extends in the vertical direction. When the lever 90 is in the second position, an upper-end face 93*b* of the preloading member 93 contacts a lower face 901*a* of the engageable section 901 in the lever 90. In other words, the lower face 901*a* of the engageable section 901 in the lever 90 may contact the preloading member 93 when the lever 90 is in the second position. Meanwhile, a lower-end section 93*c* of the preloading member 93 is coupled with a coupling section 91*b* formed at an upper end of the contacting member 91 when the lever 90 is in the firs position and in the second position.

The preloading member 93, with the upper-end face 93*b* contacting the lower face 901*a* of the engageable section 901, and with the lower-end section 93*c* coupled with the coupling section 91*b* of the contacting member 91, maintains a distance between the engageable section 901 and the coupling section 91*b* constant. This distance keeps the contractive spring 92, which is interposed between the engageable section 901 and the coupling section 91*b*, to stay stretched to be longer than the natural length. Thus, the contractive spring 92 may be maintained in the condition, in which an urging force in a contracting direction is produced.

While the preloading member 93 is interposed between the engageable section 901 and the coupling section 91*b*, the urging force is produced between the engageable section 901 and the coupling section 91*b* in a direction to be closer to each other. With this urging force, the lower face 901*a* of the engageable section 901 may be pressed against the upper-end face 93*b* of the preloading member 93.

The preloading member 93 accommodates the contractive spring 92 in the through hole 93*a*. In other words, an outer periphery of the contractive spring 92 is covered by the preloading member 93. Therefore, when, for example, the contractive spring 92 once stretched is contracting, the contractive spring 92 may be prevented from being tangled with or caught by items arranged around the outer periphery of the contracting spring 92.

Figure 6:
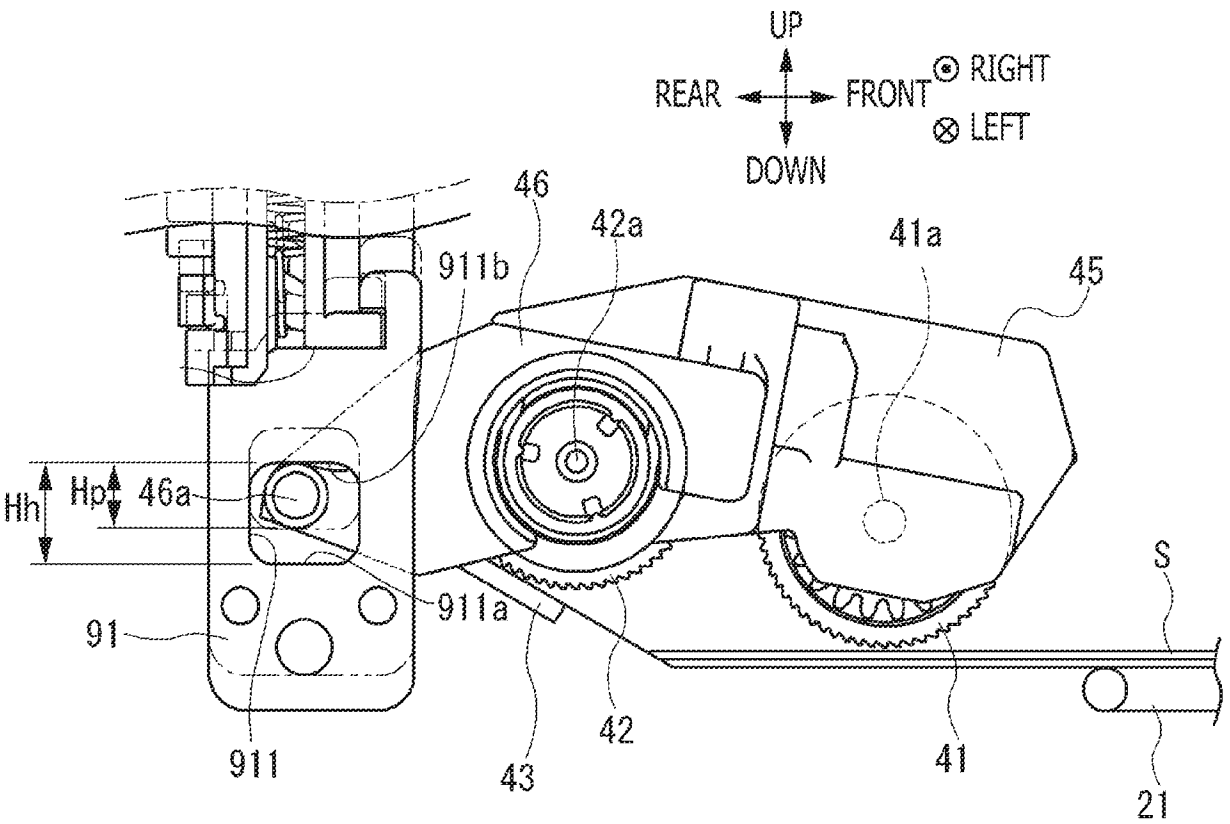
FIG. 6 is a sideward partial view of the sheet conveyer according to the embodiment of the present disclosure illustrating a dimension of an elongated hole in a contacting member and a dimension of a protrusion in the arm.

As shown in FIG. 6, the contacting member 91 has a hole section including an elongated hole 911, which may extend in the vertical direction and is engageable with the protrusion 46*a*. A dimension Hh of the elongated hole 911 in the vertical direction is greater than a dimension Hp of the protrusion 46*a* in the vertical direction. Therefore, for example, when the feed roller 41 is placed to contact the sheet S due to the weight thereof by the effect of gravity, and when the protrusion 46*a* contacts an upper edge 911*b* at an upper end of the elongated hole 911, the protrusion 46*a* is separated from a lower edge 911*a* at a lower end of the elongated hole 911, and a gap is formed between the protrusion 46*a* and the lower edge 911*a*.

As the contacting member 91 moves upward from this position where the protrusion 46*a* contacts the upper edge 911*b* of the elongated hole 911 with the feed roller 41 contacting the sheets S, the protrusion 46*a* is separated from both the upper edge 911*b* and the lower edge 911*a* of the elongated hole 911. When the contacting member 91 moves further upward, the protrusion 46*a* contacts the lower edge 911*a* but is separated from the upper edge 911*b*. In other words, while the feed roller 41 stays on the sheets S, the elongated hole 911 may shift between a state, in which the protrusion 46*a* contacts the upper edge 911*b* being one end of the elongated hole 911, as indicated in solid lines in FIG. 6, and a state, in which the protrusion 46*a* contacts the lower edge 911*a* being the other end of the elongated hole 911, as indicated in dosh-and-dots lines in FIG. 6.

Meanwhile, when the lever 90 is in the first position, the protrusion 46*a* contacts the lower edge 911*a*; and when the lever 90 is in the second position, the protrusion 46*a* contacts the upper edge 911*b*.

In this regard, it may be noted that the elongated hole 911 and the protrusion 46*a* may not necessarily be arranged in the contacting member 91 and the arm 46, respectively, but the arrangement may be inverted. In other words, the arm 46 may have an elongated hole, and the contacting member 91 may have a protrusion to engage with the elongated hole in the arm 46. Further, the elongated hole 911 may not necessarily be elongated to be longer in the vertical direction but may be, for example, a square hole as long as the protrusion 46*a* is engageable with the hole, and the dimension Hh of the elongated hole 911 along the vertical direction is larger than the dimension Hp of the protrusion 46*a* along the vertical direction.

In the sheet conveyer 4 configured as above, when the cam member 84 rotates to a rotational position shown in FIG. 3, the lever 90 may swing in a direction to move the engageable section 901 downward to the second position.

When the lever 90 is in the second position, the contacting member 91 is lowered, the protrusion 46*a* may contact the upper edge 911*b* of the elongated hole 911, and a weight of the load applier unit may be placed on the protrusion 46*a*. The weight of the load applier unit 9 placed on the protrusion 46*a* is a load in the downward direction; therefore, while the protrusion 46*a* bears the weight of the load applier unit 9, the holder 45 may be subject to a force that may cause the feed roller 41 to swing upward. Accordingly, the holder 45 may be maintained in the second position, in which the feed roller 41 is separated from the sheet S.

Meanwhile, the feed roller 41 and the load applier unit 9 are designed to weigh in a manner such that a moment acting on the holder 45 to swing in a direction to cause the feed roller 41 to be separated from the sheet S is larger than a moment acting on the holder 45 to swing in the direction to cause the feed roller to contact the sheet S, when substantially no external force is applied to the holder 45.

Therefore, when the lever 90 is in the second position, and the protrusion 46*a* contacts the upper edge 911*b* of the elongated hole 911, the weight of the load applier unit 9 is placed on the arm 46 through the protrusion 46*a*, and the holder 45 is maintained in the second holder-position against the weight of the feed roller 41. When the holder 45 is maintained in the second holder-position, the feed roller 41 is lifted upward. Therefore, the sheets S may be placed on the MP tray 21 easily. Meanwhile, when the lever 90 is in the second position, the contractive spring 92 is in a stretched condition preliminarily stretched by the preloading member 93 to be longer than the natural length.

As the lever 90 is moved by rotation of the cam member 84 from the second position in a direction to move the engageable section 901 upward, the elongated hole 911 in the contacting member 91 accompanies the lever 90 to move upward. Therefore, the holder 45 may swing due to the weight of the feed roller 41 in the direction to lower the feed roller 41 downward. As the holder 45 swings, the protrusion 46*a* maintains contact with the upper edge 911*b* of the elongated hole 911.

Figure 7:
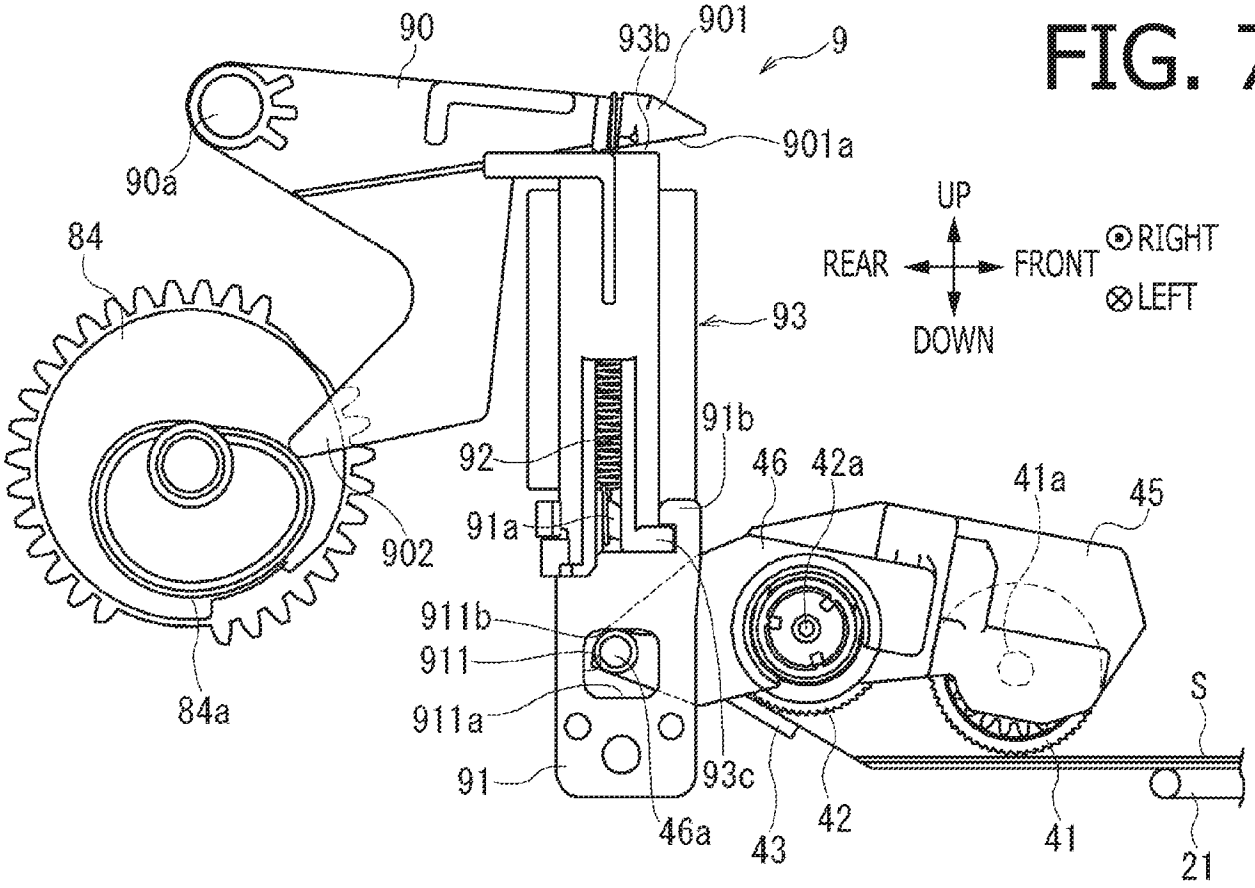
FIG. 7 is a sideward view of the sheet conveyer, with the load applier lever moved upward from the second position and the feed roller contacting a sheet, according to the embodiment of the present disclosure.

As shown in FIG. 7, as the holder 45 swings to lower the feed roller 41, the feed roller 41 may contact the sheets S. At the instant when the feed roller 41 drops downward to contact the sheet S, the contact between the protrusion 46*a* and the upper edge 911*b* of the elongated hole 911 is maintained.

When the holder 45 swinging from the second holder-position reaches the first holder-position, in which the feed roller 41 lands on the sheets S, the protrusion 46*a* and the lower edge 911*a* of the elongated hole 911 are separated from each other, and substantially no urging force of the contractive spring 92 may be applied to the holder 45. Therefore, the feed roller 41 may drop downward by the weight thereof and contact the sheet S. Accordingly, unlike a feed roller, which may produce a colliding noise when the feed roller 41 is urged against the sheets S through the holder 45 pulled by the contractive spring 92, the feed roller 41 may land on the sheet without producing a noise.

Figure 8:
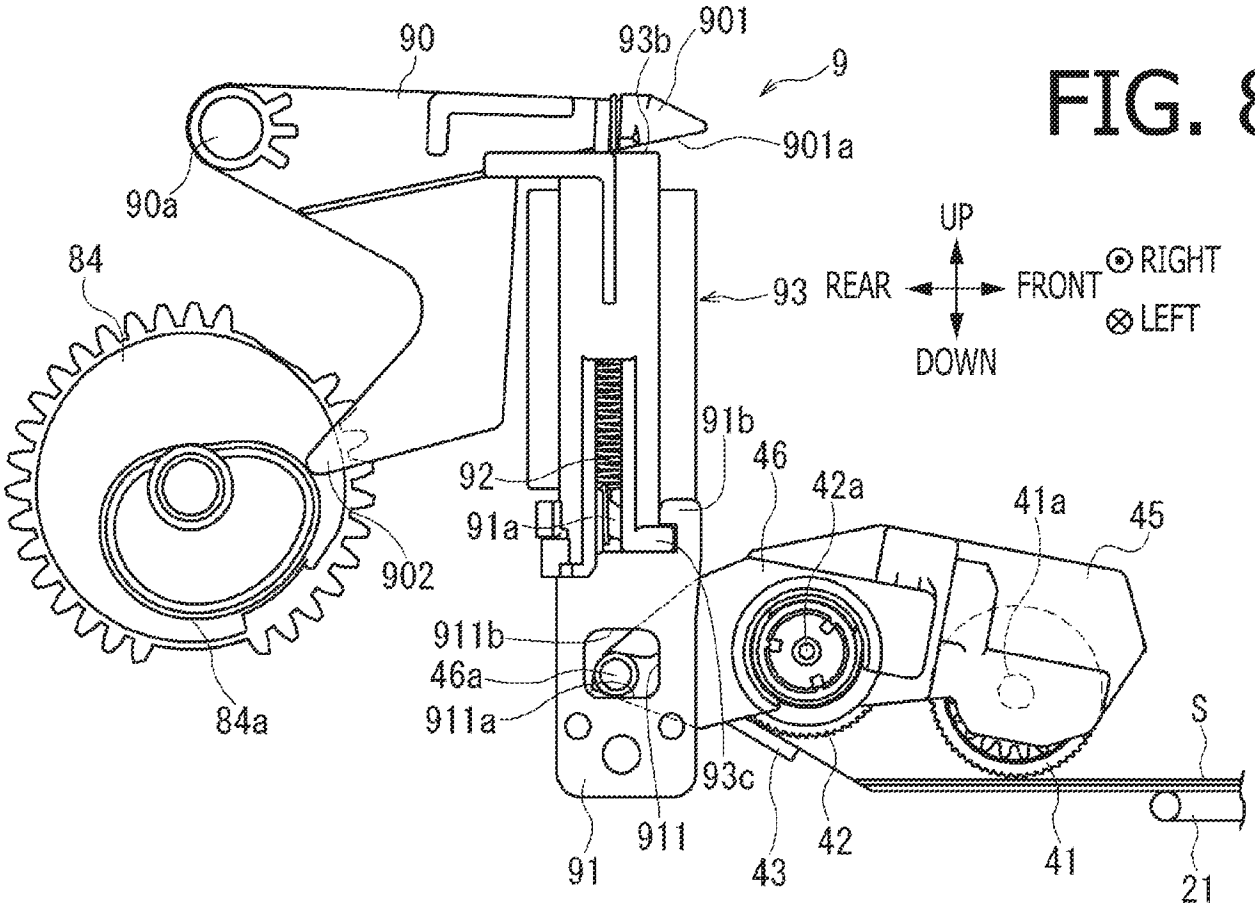
FIG. 8 is a sideward view of the sheet conveyer, with the lever moved upward and a lower edge of the elongated hole in the contacting member contacting the protrusion in the arm, according to the embodiment of the present disclosure.

As the lever 90 moves further to move the engageable section 901 upward from the position where the feed roller 41 lands on the sheets S by the weight thereof, the elongated hole 911 in the contacting member 91 may move further upward. Therefore, the upper edge 911*b* of the elongated hole 911 may be separated from the protrusion 46*a*, and, as shown in FIG. 8, the lower edge 911*a* of the elongated hole 911 may contact the protrusion 46*a*. At the instant when the lower edge 911*a* contacts the protrusion 46*a*, the protrusion 46*a* may be subject to no substantial external force. Meanwhile, the contractive spring 92 may be maintained in the stretched condition stretched by the preloading member 93.

At the instant when the lower edge 911*a* of the elongate hole 911 contacts the protrusion 46*a*, no substantial urging force of the contractive spring 92 may be applied to the holder 45. Therefore, for example, unlike a protrusion that may be hit by the lower edge 911*a* of the elongated hole 911 in the contacting member 91 being pulled by the urging force of the contractive spring 92, a noise that may be produced by the collision between the protrusion 46*a* and the lower edge 911*a* may be eliminated.

Figure 9:
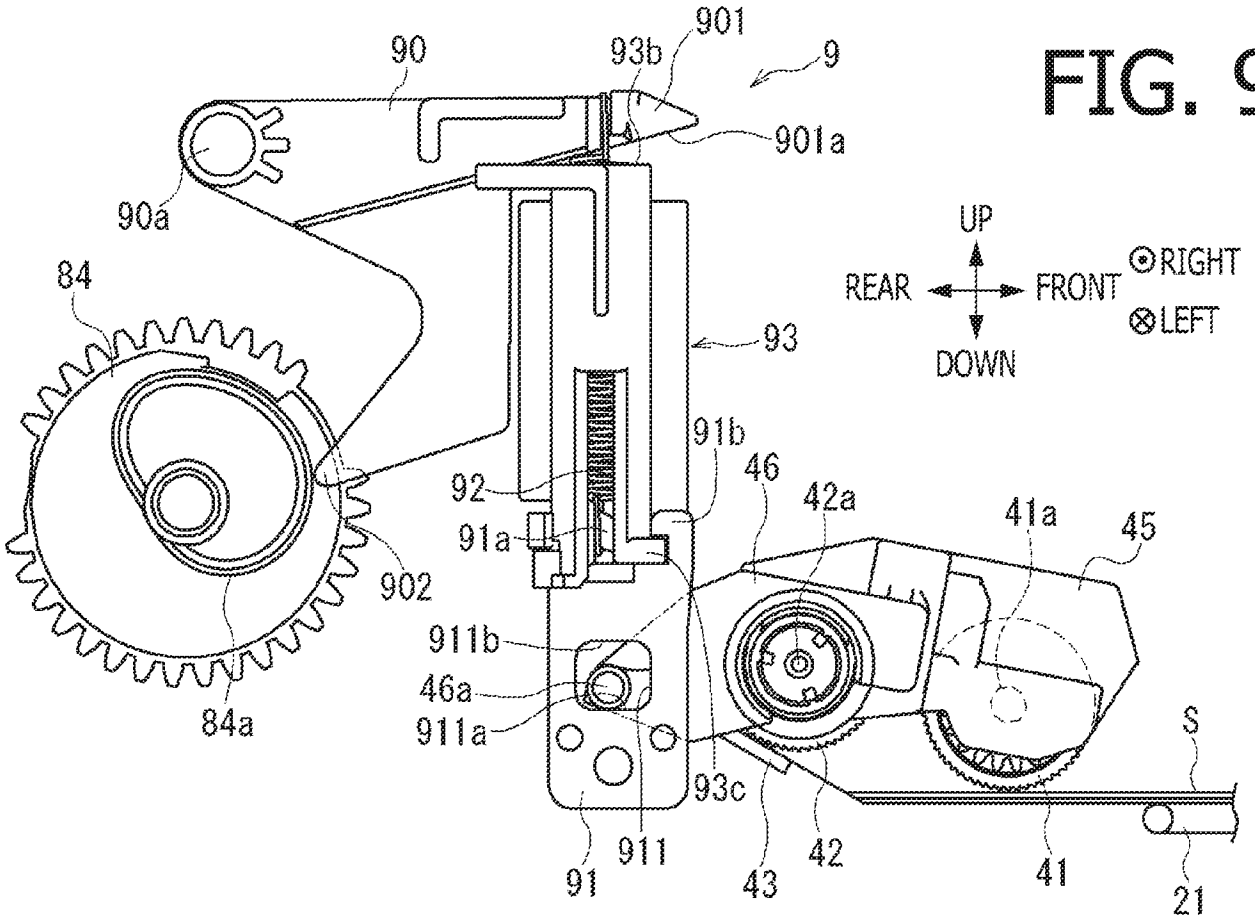
FIG. 9 is a sideward view of the sheet conveyer according to the embodiment of the present disclosure with the lever being in a first position.

As the cam member 84 rotates further, the lever 90 may swing further in the direction to move the engageable section 901 upward and reach the first position. As shown in FIG. 9, the contractive spring 92 may be stretched further by the lever 90 to be longer than the preliminarily stretched length stretched by the preloading member 93, and the contacting member 91 may be urged upward. The urging force from the contractive spring 92 may be transmitted to the protrusion 46*a* in the arm 46, which is engaged with the lower edge 911*a* of the elongated hole 911, and a load acting in the direction to cause the feed roller 41 to be pressed against the sheet S may be applied to the holder 45.

In other words, as the lever 90 moves to the first position, in which the lever 90 pulls the contractive spring 92 to stretch longer, the protrusion 46*a* may contact the lower edge 911*a* of the elongated hole 911, and the load that may act in the direction to cause the feed roller 41 to be pressed against the sheet S may be applied to the arm 46, and the holder 45 may be maintained in the first holder-position.

Thus, in the sheet conveyer 4 described above, when the lever 90 is moving from the second position to the first position, the feed roller 41 drops downward by the weight thereof and contacts the sheets S. Meanwhile, the state, in which the protrusion 46*a* contacts the upper edge 911*b* of the elongated hole 911, shifts to the state, in which the protrusion 46*a* contacts the lower edge 911*a* of the elongated hole 911. Further, the load acting in the direction to cause the feed roller 41 to be pressed against the sheet S is applied to the arm 46. Thus, the pressure by the urging force of the contractive spring 92 to feed the sheet S may be applied to the feed roller 41 after the feed roller 41 lands on the sheet S. Therefore, a colliding noise that may be produced when the feed roller 41 hits the sheet S may be reduced, and the sheet conveyer 4 may be operated more quietly.

Meanwhile, the contractive spring 92 is maintained in the condition preliminarily stretched by the preloading member 93 to be longer than the natural length. In this regard, a greater intensity of urging force may be produced in the contractive spring 92 from the instant when the lever 90 starts pulling the contractive spring 92 than a contractive spring 92, which is not preliminarily stretched but is in the natural length. Therefore, a substantial amount of pressure to convey the sheet S may be applied to the feed roller 41 when the feed roller 41 is driven to feed the sheet S even though the feed roller 41 may not standby with the load from the contractive spring 92 applied thereto while the feed roller 41 merely stays contacting on the sheet S. In this way, the noise that may be produced when the feed roller 41 contacts the sheet S may be moderated or reduced.

Meanwhile, the lever 90 is swingable about the swing axis 90*a* to move between the first position and the second position. The first position and the second position of the lever 90 may be designed in a manner such that the engageable section 901 of the lever 90 being in the first position and the engageable section 901 of the lever 90 being in the second position are in mutually overlapping positions in a view along the vertical direction.

Figure 10:
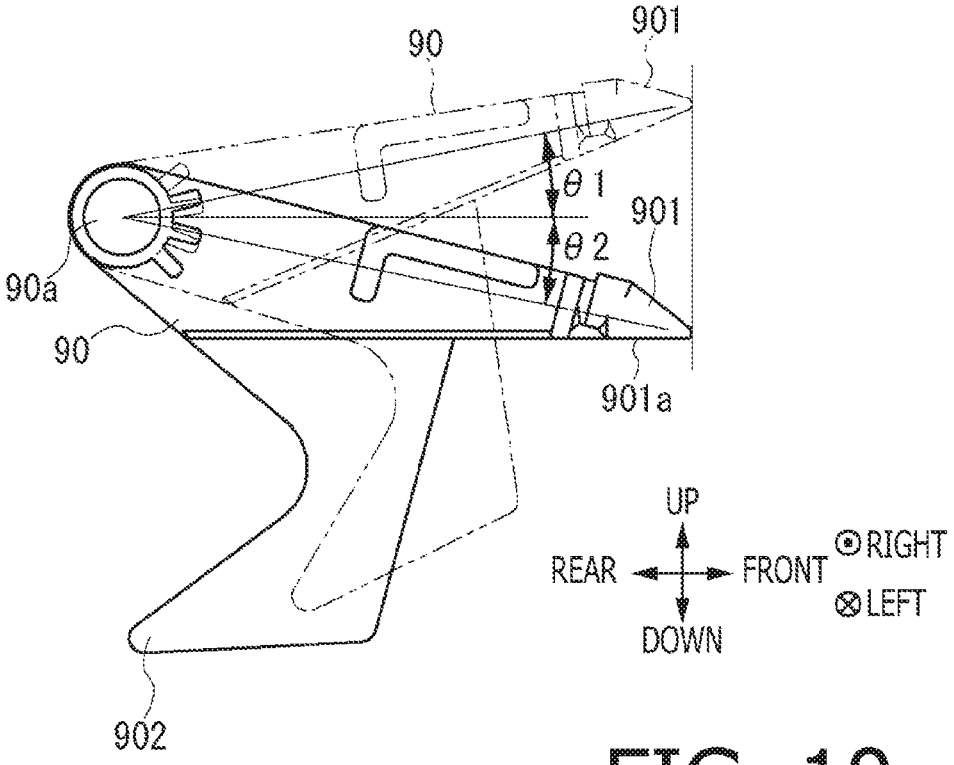
FIG. 10 is a sideward view of the lever in the sheet conveyer according to the embodiment of the present disclosure illustrating vertically overlapping positions of engageable section in the lever when the lever is in the first position and in the second position.

For example, as shown in FIG. 10, the lever 90 may be configured such that an absolute value of inclination angle θ1, which is between a horizontal line and a line extending through the swing axis 90*a* and the engageable section 901 of the lever 90 in the first position (indicated in dash-and-dots lines in FIG. 10), and an absolute value of inclination angle θ2, which is between the horizontal line and the line extending through the swing axis 90*a* and the engageable section 901 of the lever 90 in the second position (indicated in solid lines in FIG. 10), are equal. In this arrangement, the positions of the engageable section 901 with regard to the front-rear direction when the lever is in the first position and in the second position may overlap in a view along the vertical direction. In this regard, positions of the engageable section 901 with regard to the front-rear direction when the lever 90 is in the first position and in the second position may not be apart from each other but may stay within a smaller range along the horizontal direction. Therefore, the load from the contractive spring 92 to be applied to the holder 45 may not vary largely depending on the position of the lever 90, and the load from the contractive spring 92 may be effectively applied to the holder 45.

[Benefits]

The image forming apparatus 1 according to the embodiment has the sheet conveyer 4, which includes the MP tray 21; the feed roller 41; the separator roller 42; the holder 45; the arm 46; the load applier unit including the contacting member 91, the lever 90, and the contractive spring 92; and the cam member 84. One of the contacting member 91 and the arm 46 has one of the protrusion 46*a* vertically movable and the elongated hole 911 engageable with the protrusion 46*a*, and the other of the contacting member 91 and the arm 46 has the other of the protrusion 46*a* and the elongated hole 911. The dimension Hh of the elongated hole 911 in the vertical direction is greater than the dimension Hp of the protrusion 46*a* in the vertical direction so that the protrusion 46*a* is movable in the elongated hole 911 while the feed roller 41 stays contacting the sheets S to shift between the state, in which the protrusion 46*a* contacts the upper edge 911*b* of the elongated hole 911, and the state, in which the protrusion 46*a* contacts the lower edge 911*a* of the elongated hole 911. The holder 45 is movable between the first holder-position, in which the feed roller 41 contacts the sheets S, and the second holder-position, in which the feed roller 41 is separated from the sheets S. The holder 45 is maintained in the second holder-position against the weight of the feed roller 41 when the protrusion 46*a* contacts the upper edge 911*b* of the elongated hole 911 and applies the weight of the load applier unit 9 to the arm 46. The holder is maintained in the first holder-position when the protrusion 46*a* contacts the lower edge 911*a* of the elongated hole 911 and applies the load by the urging force from the contractive spring 92 that acts in the direction to press the feed roller 41 against the sheets S to the arm 46.

In this configuration, while the protrusion 46*a* contacting the upper edge 911*b* of the elongated hole 911 moves to be closer to the lower edge 911*a* of the elongated hole 911, the feed roller 41 may drop downward by the effect of gravity and contact the sheets S, and thereafter, the protrusion 46*a* contacting the lower edge 911*a* of the elongated hole 911 may move to contact neither the lower edge 911*a* nor the upper edge 911*a* and may move further to contact the lower edge 911*a* of the elongated hole 911 so that the load that may act to cause the feed roller 41 to be pressed against the sheet S may be applied to the arm 46. In this way, the pressure by the urging force of the contractive spring 92 to feed the sheets S may not be applied to the feed roller 41 until the feed roller 41 completely lands on the sheet S. Therefore, a colliding noise that may be produced when the feed roller 41 hits the sheet S may be reduced, and the sheet conveyer 4 may be operated more quietly.

Meanwhile, the lever 90 may be moved by the cam member 84 being driven between the first position, in which the lever 90 being moved in the direction to stretch the contractive spring 92 may cause the protrusion 46*a* to contact the lower edge 911*a* of the elongated hole 911 and cause the load applier unit 9 to apply the load that may act in the direction to press the feed roller 41 against the sheets S, and the second position, in which the protrusion 46*a* may contact the upper edge 911*b* of the elongated hole 911 and cause the weight of the load applier unit 9 to be applied to the arm 46.

Therefore, while the lever 90 moves from the second position to be closer to the first position, the protrusion 46*a* contacting the upper edge 911*b* of the elongated hole 911 may move to contact the lower edge 911*a* of the elongated hole 911, and the pressure by the urging force of the contractive spring 92 to feed the sheet S may not be applied to the feed roller 41 until the feed roller 41 completes landing on the sheet S. Therefore, a colliding noise that may be produced when the feed roller 41 hits the sheet S may be reduced, and the sheet conveyer 4 may be operated more quietly.

Meanwhile, the sheet conveyer 4 may include the preloading member 93, which may be interposed between the contacting member 91 and the lever 90 and may maintain the contractive spring 92 in the condition stretched to be longer than the natural length.

With the contractive spring 92 being stretched preliminarily by the preloading member 93, a substantial amount of pressure to convey the sheet S may be applied to the feed roller 41 when the feed roller 41 is driven to feed the sheet S even though the feed roller 41 may not standby with the load from the contractive spring 92 applied thereto while the feed roller 41 merely stays contacting on the sheet S. In this way, the noise that may be produced when the feed roller 41 contacts the sheet S may be moderated or reduced.

Meanwhile, the lever 90 may include the engageable section 901, at which the lever 90 may be engaged with the contractive spring 92. The lever 90 may swing the engageable section 901 about the swing axis 90*a* between the first position and the second position. The engageable section 901 of the lever being in the first position and the engageable section 901 of the lever being in the second position may be in mutually overlapping positions in the view along the vertical direction.

Therefore, positions of the engageable section 901 with regard to the horizontal direction when the lever 90 is in the first position and in the second position may not be apart from each other but may stay within a smaller range along the horizontal direction. Therefore, the load from the contractive spring 92 to be applied to the holder 45 may not vary largely depending on the position of the lever 90, and the load from the contractive spring 92 may be effectively applied to the holder 45.

Although an example of carrying out the invention has been described, those skilled in the art will appreciate that there are numerous variations and permutations of the sheet conveyer and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. A sheet conveyer, comprising:

a tray configured to support a plurality of sheets;

a feed roller configured to contact one of the plurality of sheets and rotate to convey the one of the plurality of sheets in a conveying direction;

a separator roller arranged downstream from the feed roller along the conveying direction, the separator roller being configured to separate the one of the plurality of sheets conveyed by the feed roller from at least another one of the plurality of sheets;

a holder supported swingably to swing about a rotation shaft of the separator roller, the holder supporting the feed roller rotatably;

an arm extending along an axial direction of the rotation shaft of the separator roller, the arm being engaged with the holder and configured to swing the holder;

a load applier unit configured to apply a load to the holder through the arm, the load applier unit comprising:

a contacting member engaged with the arm;

a lever movable in a vertical direction; and a contractive spring engaged with the contacting member and the lever, the contractive spring being configured to contract in a contracting direction to pull the contacting member and the lever to be closer to each other; and a cam member configured to be driven by a driving source to move the lever in the vertical direction, wherein one of the contacting member and the arm has one of a protrusion vertically movable and a hole section engageable with the protrusion, and the other of the contacting member and the arm has the other of the protrusion and the hole section, wherein a dimension of the hole section in the vertical direction is greater than a dimension of the protrusion in the vertical direction, the protrusion being movable in the hole section while the feed roller stays in contact with the one of the plurality of sheets to shift between a state in which the protrusion contacts one end of the hole section, and a state in which the protrusion contacts the other end of the hole section, wherein the holder is movable between a first holder-position, in which the feed roller contacts the one of the plurality of sheets, and a second holder-position, in which the feed roller is separated from the one of the plurality of sheets, wherein the holder is maintained in the second holder-position against a weight of the feed roller when the protrusion contacts the one end of the hole section and applies a weight of the load applier unit to the arm, and wherein the holder is maintained in the first holder-position when the protrusion contacts the other end of the hole section and applies a load by an urging force from the contractive spring that acts in a direction to press the feed roller against the plurality of sheets to the arm.

2. The sheet conveyer according to claim 1, wherein the lever is movable by the cam member being driven between:

a first position, in which the lever being moved in a direction to stretch the contractive spring causes the protrusion to contact the other end of the hole section and causes the load applier unit to apply the load that acts in the direction to press the feed roller against the plurality of sheets; and a second position, in which the protrusion contacts the one end of the hole section and causes the weight of the load applier unit to be applied to the arm.

3. The sheet conveyer according to claim 2, further comprising a preloading member interposed between the contacting member and the lever, the preloading member being configured to maintain the contractive spring in a condition stretched to be longer than a natural length.

4. The sheet conveyer according to claim 2, wherein the lever includes an engageable section, at which the lever is engaged with the contractive spring, the lever being configured to swing the engageable section about a swing axis between the first position and the second position; and wherein the engageable section of the lever being in the first position and the engageable section of the lever being in the second position are in mutually overlapping positions in a view along the vertical direction.

5. An image forming apparatus, comprising:

an image forming unit; and a sheet conveyer, the sheet conveyer comprising:

a tray configured to support a plurality of sheets;

a feed roller configured to contact one of the plurality of sheets and rotate to convey the one of the plurality of sheets in a conveying direction;

a separator roller arranged downstream from the feed roller along the conveying direction, the separator roller being configured to separate the one of the plurality of sheets conveyed by the feed roller from at least another one of the plurality of sheets;

a holder supported swingably to swing about a rotation shaft of the separator roller, the holder supporting the feed roller rotatably;

an arm extending along an axial direction of the rotation shaft of the separator roller, the arm being engaged with the holder and configured to swing the holder;

a load applier unit configured to apply a load to the holder through the arm, the load applier unit comprising:

a contacting member engaged with the arm;

a lever movable in a vertical direction; and a contractive spring engaged with the contacting member and the lever, the contractive spring being configured to contract in a contracting direction to pull the contacting member and the lever to be closer to each other; and a cam member configured to be driven by a driving source to move the lever in the vertical direction, wherein one of the contacting member and the arm has one of a protrusion vertically movable and a hole section engageable with the protrusion, and the other of the contacting member and the arm has the other of the protrusion and the hole section, wherein a dimension of the hole section in the vertical direction is greater than a dimension of the protrusion in the vertical direction, the protrusion being movable in the hole section while the feed roller stays in contact with the one of the plurality of sheets to shift between a state, in which the protrusion contacts one end of the hole section, and a state, in which the protrusion contacts the other end of the hole section, wherein the holder is movable between a first holder-position, in which the feed roller contacts the one of the plurality of sheets, and a second holder-position, in which the feed roller is separated from the one of the plurality of sheets, wherein the holder is maintained in the second holder-position against a weight of the feed roller when the protrusion contacts the one end of the hole section and applies a weight of the load applier unit to the arm, and wherein the holder is maintained in the first holder-position when the protrusion contacts the other end of the hole section and applies a load by an urging force from the contractive spring that acts in a direction to press the feed roller against the plurality of sheets to the arm.

* * * * *